US008125303B2

(12) United States Patent
Klingel et al.

(10) Patent No.: US 8,125,303 B2
(45) Date of Patent: Feb. 28, 2012

(54) SOLENOID SWITCH FOR STARTERS

(75) Inventors: Juergen Klingel, Sachsenheim-Hohenhaslach (DE); Thomas Fischer, Miskolc (HU)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/593,548

(22) PCT Filed: Feb. 1, 2008

(86) PCT No.: PCT/EP2008/051284
§ 371 (c)(1),
(2), (4) Date: Sep. 28, 2009

(87) PCT Pub. No.: WO2008/116684
PCT Pub. Date: Oct. 2, 2008

(65) Prior Publication Data

US 2010/0127806 A1 May 27, 2010

(30) Foreign Application Priority Data

Mar. 28, 2007 (DE) ..... 10 2007 014 764

(51) Int. Cl.
*H01H 67/02* (2006.01)

(52) U.S. Cl. ..... 335/126; 335/131

(58) Field of Classification Search ..... 335/126, 335/131
See application file for complete search history.

(56) References Cited

U.S. PATENT DOCUMENTS

| | | | | |
|---|---|---|---|---|
| 2,951,133 | A * | 8/1960 | Davies et al. | 335/154 |
| 4,172,439 | A * | 10/1979 | Pasbrig | 123/634 |
| 4,945,777 | A * | 8/1990 | Isozumi | 74/7 E |
| 5,039,967 | A * | 8/1991 | Morishita et al. | 335/131 |
| 5,227,751 | A * | 7/1993 | Shiroyama et al. | 335/126 |
| 5,245,304 | A * | 9/1993 | Zenmei | 335/126 |
| 5,359,306 | A * | 10/1994 | Fasola et al. | 335/126 |
| 5,631,613 | A | 5/1997 | Niimi et al. | |
| 5,909,067 | A | 6/1999 | Liadakis | |
| 5,973,581 | A * | 10/1999 | Jacquin et al. | 335/131 |
| 6,268,670 | B1 * | 7/2001 | Kuragaki et al. | 310/75 R |
| 6,269,706 | B1 * | 8/2001 | Kuragaki et al. | 74/7 A |
| 6,404,310 | B1 | 6/2002 | Ando et al. | |
| 6,466,116 | B1 * | 10/2002 | Ho et al. | 335/126 |
| 6,693,503 | B1 | 2/2004 | Nguyen et al. | |
| 6,762,663 | B2 * | 7/2004 | Andoh et al. | 335/126 |

(Continued)

FOREIGN PATENT DOCUMENTS

DE 197 35 326 3/1998

(Continued)

OTHER PUBLICATIONS

International Search Report, PCT/EP2008/051284 dated Jun. 23, 2008.

*Primary Examiner* — Lincoln Donovan
*Assistant Examiner* — Alexander Talpalatskiy
(74) *Attorney, Agent, or Firm* — Kenyon & Kenyon LLP

(57) ABSTRACT

A solenoid switch for starters of internal combustion engines has a switch cover in an end-faced manner to the switch housing enclosing the magnetic armature which, in the vicinity of the circumferential edge zones of passageway openings for switch bolts that are to be braced axially against switch cover, is made of a material that is more rigid to compression than in the rest of the cover region.

4 Claims, 1 Drawing Sheet

U.S. PATENT DOCUMENTS

| | | | | |
|---|---|---|---|---|
| 6,937,122 | B2 * | 8/2005 | Ho et al. | 335/126 |
| 6,943,655 | B1 | 9/2005 | McMahon et al. | |
| 7,038,563 | B2 * | 5/2006 | Andoh et al. | 335/126 |
| 7,639,108 | B2 * | 12/2009 | Miyake | 335/126 |
| 2002/0145494 | A1 | 10/2002 | Andoh et al. | |
| 2004/0169573 | A1 * | 9/2004 | Andoh et al. | 335/126 |

FOREIGN PATENT DOCUMENTS

| | | |
|---|---|---|
| DE | 198 14 504 | 6/1999 |
| DE | 199 51 116 | 4/2001 |
| DE | 100 57 809 | 5/2001 |
| DE | 100 44 940 | 6/2002 |
| DE | 102 13 286 | 10/2002 |
| DE | 102 60 843 | 7/2004 |
| FR | 2 752 998 | 3/1998 |
| GB | 793 811 | 4/1958 |
| GB | 1 290 524 | 9/1972 |
| GB | 2 028 590 | 3/1980 |
| JP | 2001-155609 | 6/2001 |

* cited by examiner

SOLENOID SWITCH FOR STARTERS

FIELD OF THE INVENTION

The present invention relates to a solenoid switch for a starter of internal combustion engines.

BACKGROUND INFORMATION

Solenoid switches of the abovementioned type are conventional parts of the starting system for internal combustion engines of motor vehicles in multiple refinements, as also in a basic construction that is described in DE 198 14 504.

Such solenoid switches have a housing which accommodates a controlling magnet which acts upon a meshing drive via a control connection. Via the meshing drive, and in its meshed control position, the starter is drive-connected to the internal combustion engine in order to start it.

Opposite to the actuator acted upon by the magnet, the housing is covered by a switch cover at its end face, while defining an accommodation space. In this accommodation space there are contact surfaces of switch bolts, which pass through the end face wall of the cover and are axially braced with respect to it. For this purpose, the contact surfaces lying within the accommodation space are associated with broadened head parts of the switch bolts, which are supported on the edge of the cover wall next to the passageway opening, with respect to which the switch bolt is axially braced via an opposite nut screwed onto the switch bolt.

The switch bolts braced in a fixed position with respect to the switch cover extend outwards beyond the cover and are line-connected to the battery (terminal 30) and the starter motor (terminal 45). Depending on the respective position in the vehicle, as well as on conditions related to accidents, the switch bolts may also be exposed to abruptly larger forces. A possible break in the cover, caused by this, may lead to a short circuit connection between the switch bolt connected to the battery (terminal 30) and the body shell.

SUMMARY

Example embodiments of the present invention provide a solenoid switch, in such a way with respect to its cover that, without any impairment of the axially bracing fixing of the switch bolts to the cover of the switch, there exists no danger of a break of the cover even at extreme loads acting upon the switch bolts.

The design approach according to example embodiments of the present invention relates to, in the case of the fixed-position, durable bracing of the bolts with respect to the switch cover, the switch cover is made of an elastically deformable plastic material, and, regardless of the setting characteristics of such a plastic material, in the case of loads existing because of the axial bracing of the switch bolt with respect to the cover, the fixed and position-ensuring position of the switch bolt is assured by, in the vicinity of the edge zone of a respective passageway opening, the cover being rigid to pressure, i.e. pressure-resistant.

Thus, on the one hand, the bracing force required for ensuring the position of the switch bolt, with respect to the switch cover, is able to be maintained and, on the other hand, because of the flexibility of the cover, it is able to be ensured that extreme, particularly abrupt loads acting on the respective switch bolt are able to be at least partially intercepted by appropriate elastic deformations of the cover.

The arrangement of the edge zone of a passageway opening, that is particularly edge-enclosing, and axially inflexible, may be achieved, regardless of the rigid design of the cover, made of deformable, particularly elastically deformable plastic in that, during molding of the cover, plastic materials of different elasticity and different setting characteristics are used for the various areas of the cover, the material for the pressure-stressed edge zone of a respective passageway opening being able to be inserted even offset in time, if necessary.

An arrangement is also possible, in which the same elastically deformable plastic is used continually for the switch cover, but in the edge zone of a respective passageway opening, in each case a stiffening insertion is made as an insert or framework, which extends between the axially opposite support surfaces, at least over parts of the circumference of the passageway.

An example embodiment includes assigning a sleeve to the passageway opening as an edge-side limitation and insert, this sleeve being able to be connected to the base material of the cover in a continuous material or form locking manner.

As a deformable, particularly an elastically deformable base material for the cover, especially thermoplastic materials may be provided, while for the axially extending, pressure-loaded edge region of a respective passageway opening, or for the insert assigned to this edge region, thermosetting plastics should be considered, in particular.

Further features and aspects of example embodiments are described below with reference to the appended Figures

DETAILED DESCRIPTION

Figure 1:
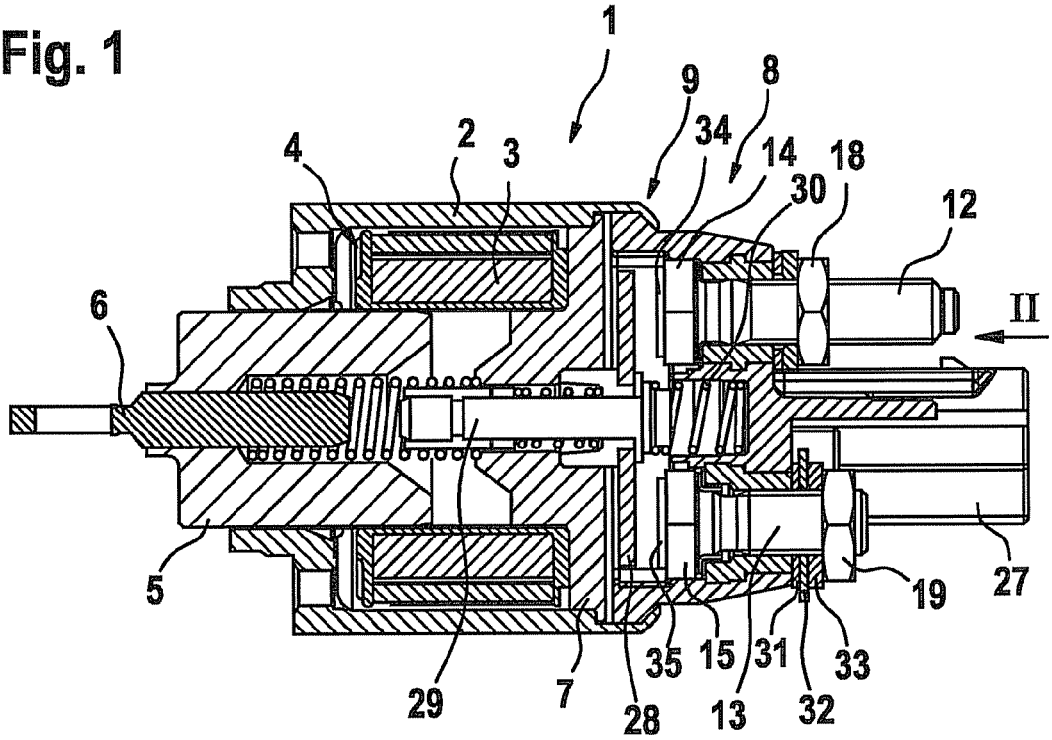
FIG. 1 shows, in a longitudinal center section, a simplified overview of a solenoid switch for starters of internal combustion engines.
Figure 2:
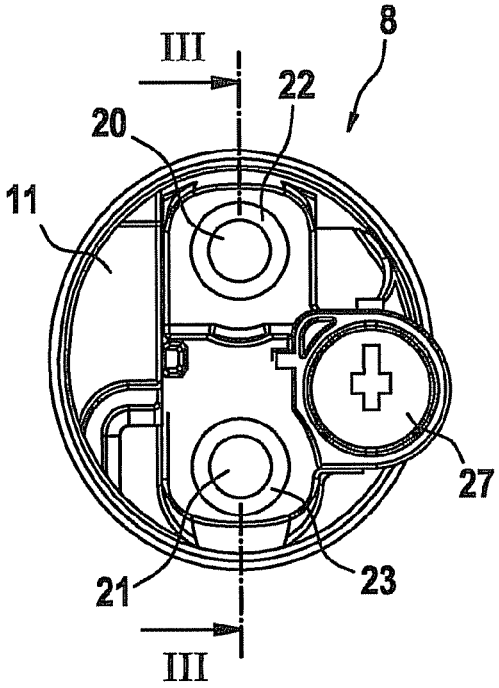
FIG. 2 shows an end face top view in the direction of arrow II onto the cover of the solenoid switch according to FIG. 1, without the switch bolts braced with respect to the cover.

The sectional illustration according to FIG. 1 shows a solenoid switch 1 for starters of internal combustion engines, in an overview. The switch housing is designated as 2, which encloses windings 3 of a controlling magnet 4 which, on their part, lie circumferentially to axially shiftable magnet armature 5. Magnet armature 5 is connected in fixed position to an actuating rod 6, which is a component of a control connection to a meshing drive, via which the starter is connected to the internal combustion engine when the internal combustion engine is started. Starting systems of this type are described, for example, in "Kraftfahrtechnisches Taschenbuch", Bosch 23. Edition, ISBN 3-528-03876-4, pp. 571 to 574. Furthermore, DE 198 14 504 shows and describes a solenoid switch which corresponds to the one in FIG. 1, in its basic design.

Covering a magnetic core 7 that is situated at the end face of switch housing 2, housing 2 is connected to a switch cover 8. In this exemplary embodiment, this switch cover 8 is crimped at 9 circumferentially onto switch housing 2.

Switch cover 8 is arranged to be bowl-shaped and delimits an accommodation space 10 from switch housing 2 and magnetic core 7.

Switch bolts 12 and 13, that pass through switch cover 8 in its end-faced cover wall 11, end in this accommodation space 10, of which switch bolt 12, as terminal 30, is connected to the battery and switch bolt 13, as terminal 45, is connected to the starter motor. Furthermore, a connection 27—terminal 50—to the ignition lock is assigned to cover 8.

Switch bolts 12 and 13 extend towards accommodation space 10 ending in head parts 14, 15 which have a greater cross section, at least in regions, compared to switch bolts 12 and 13, and which engage over the peripheral edge zone towards the respective passageway openings 16, 17 that accommodate respective switch bolts 12 and 13. Head parts 14, 15 have corrugated contact surfaces 34, 35 which are connected via a contact bridge 28, when current is supplied to solenoid switch 1, which is adjustable via a switch shaft 29 by magnetic armature 5 and is acted upon counter to the control direction of magnetic armature 5 when current is supplied, by a spring 30 that is situated in switch cover 8.

Figure 3:
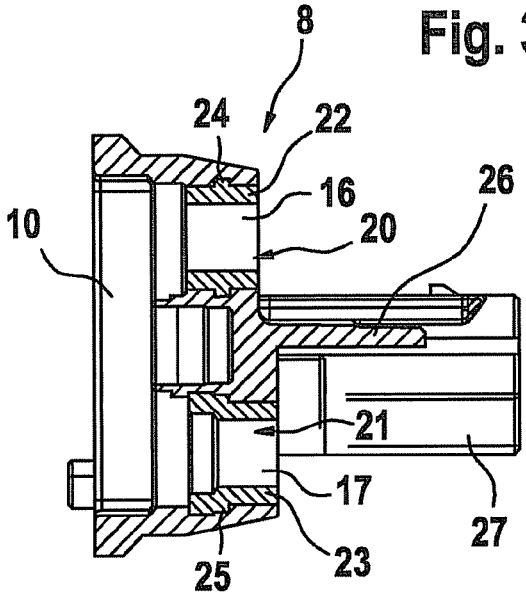
FIG. 3 shows a section according to III-III in FIG. 2.

This axial support takes place in the region of inserts 20, 21, which—see especially FIG. 3—are provided to be the linings of respective passageway openings 16, 17, and which are formed by sleeves 22, 23 in the exemplary embodiment shown. Sleeves 22, 23 are each made of a plastic material which is inflexible with respect to the axial bracing forces that are a given in this case, and which has no substantial setting characteristics, and thus is a thermosetting plastic, in particular, and they are form-locking and/or have continuous material with the respectively enclosing region of cover wall 11, for instance, in that sleeves 22, 23 are molded around with the material of cover 8, during the production of cover 8. Between sleeves 22, 23 and adjusting nuts 18, 19 there is in each case a tooth lock washer 31, respective cable lug 32 and a spring lock washer 33.

Since the forces mounted axially for bracing switch bolts 12, 13 are supported via sleeves 22, 23, switch cover 8 may be provided, both with respect to the material and to the shaping, to the extent that forces solenoid switch bolt 12 and 13, such as forces, for instance, becoming effective, through support, abruptly at parts of the body, because of an accident, only lead to deformations of cover 8, but not to a break in cover 8, or to any other type of releasing of respective switch bolt 12, 13 from the connection to switch cover 8, which is especially critical with respect to switch bolt 12 that is connected to the battery as terminal 30, because of the danger of a short circuit connected with that.

FIGS. 1 and 3 show that sleeves 22, 23 may be fixed to switch cover 8 both by material locking, as, for instance, by the corresponding adhesion of the working materials during molding, and by form locking, the form-locking fixing being able to be achieved by radial overlapping, at least in regions, of respective sleeve 22, 23 and the enclosing part of switch cover 8. Such undercutting is achieved with respect to sleeve 22 by collar 25, and with respect to sleeve 21 by collar 26, collar 25 being designed in step-wise manner, in adaptation to the axially stepped arrangement of switch bolt 13.

In the region between switch bolts 12 and 13, cover 8 is provided with a rising screening wall 26.

Example embodiments of the present invention provide a design approach in which switch cover 8, made of plastic, demonstrates overall, at least in the vicinity of cover wall 11, an elastic behavior, namely in response to a development, that is axially rigid to compression and has no setting behavior, of the edge region enclosing passageway openings 16, 17.

What is claimed is:

1. A solenoid switch for starters of internal combustion engines, comprising:

a switch housing, which has a switch cover made of plastic at an end face, at which switch terminals are provided which are formed by switch bolts passing through a cover wall in passageway openings, formed as sleeves, which are fixed to the cover wall by axial bracing against mutually opposite wall sides enclosing the respective passageway opening;

wherein the sleeves are formed of a first plastic material and are axially inflexible, and wherein the remainder of the switch cover is made of an elastically deformable second plastic material different from the plastic material.

2. The solenoid switch according to claim 1, wherein the sleeves are connected to a material of the remainder of the switch cover in at least one of (a) a material-locking and (b) a form-locking manner.

3. The solenoid switch according to claim 1, wherein a thermoplastic material is provided as the second plastic material.

4. The solenoid switch according to claim 1, wherein a thermosetting plastic material is provided as the first plastic material.

* * * * *